US005549412A

United States Patent [19]

Malone

[11] Patent Number: 5,549,412

[45] Date of Patent: Aug. 27, 1996

[54] POSITION REFERENCING, MEASURING AND PAVING METHOD AND APPARATUS FOR A PROFILER AND PAVER

[75] Inventor: Kerry Malone, Charleston, Ill.

[73] Assignee: Blaw-Knox Construction Equipment Corporation, Matton, Ill.

[21] Appl. No.: 449,075

[22] Filed: May 24, 1995

[51] Int. Cl.[6] ..... E01C 19/22

[52] U.S. Cl. ..... 404/84.1; 404/84.2

[58] Field of Search ..... 404/84.05, 84.1, 404/84.2, 84.5, 118

[56] References Cited

U.S. PATENT DOCUMENTS

| | | | |
|---|---|---|---|
| 3,259,034 | 7/1966 | Davin . | |
| 3,604,512 | 9/1971 | Carter et al. . | |
| 3,675,545 | 7/1972 | Anderson et al. . | |
| 3,846,035 | 11/1974 | Davin . | |
| 3,879,149 | 4/1975 | Smith et al. | 404/84.1 X |
| 4,473,319 | 9/1984 | Spangler . | |
| 5,044,820 | 9/1991 | Prang . | |
| 5,119,102 | 6/1992 | Barnard . | |
| 5,288,166 | 2/1994 | Allen et al. . | |
| 5,288,167 | 2/1994 | Gaffard et al. . | |
| 5,299,130 | 3/1994 | Ono . | |
| 5,328,295 | 7/1994 | Allen . | |
| 5,333,966 | 8/1994 | St-Louis et al. | 404/84.05 |
| 5,337,243 | 8/1994 | Shibata et al. . | |
| 5,356,238 | 10/1994 | Musil et al. . | |
| 5,362,177 | 11/1994 | Bowhall et al. . | |

*Primary Examiner*—Michael Powell Buiz
*Assistant Examiner*—James A. Lisehora
*Attorney, Agent, or Firm*—Pearne, Gordon, McCoy & Granger

[57] ABSTRACT

A profiler is used to collect data on a base surface. An asphalt paver is provided with a like profiler that measures smoothness of a fresh mat of asphalt laid by the paver. The profilers measure surface elevation as a function of forward travel position. The profiler and paver position are determined by a fixed referencing system, such as the Global Positioning System (GPS). Surface elevation is plotted against position of the profiler and used to control a screed levelling a mat of paving material. A subsequent plot shows smoothness of the mat.

33 Claims, 6 Drawing Sheets

POSITION REFERENCING, MEASURING AND PAVING METHOD AND APPARATUS FOR A PROFILER AND PAVER

BACKGROUND OF THE INVENTION

1. Field of the Invention

This invention relates generally to the field of paving and specifically to a surface profiler used in a paving operation.

2. Description of the Related Art

In laying asphalt pavement roadways and the like, it is widespread practice to employ so-called "floating screed" paving machines. These machines include a tractor-like main frame having an engine for propulsion and for material distributing functions. Typically, there is a material receiving hopper at the front of the paver arranged to receive hot asphalt material from a truck as the paving machine advances along the roadbed. Slat conveyors or the like are provided to convey the material from the hopper, at the front of the machine, toward the floating screed, at the back of the machine. Immediately in front of the screed, there is typically provided a distributing auger, which receives the raw asphalt material from the slat conveyor and conveys it laterally so as to distribute the material along the front edge of the screed. As the machine advances along the prepared roadbed, the raw asphalt material flows under the screed, which levels, smooths and compacts the material to provide a continuous, level pavement mat.

In a typical floating screed asphalt paver, the screed is attached to a pair of forwardly extending tow arms that engage the paver frame at their forward extremities. These tow arms are also connected to the paver frame by hydraulic or other actuators arranged to adjust the vertical position of the tow arm extremities in relation to the paver frame. By effecting proper control over the position of the tow arm forward extremities, the screed is maintained in relation to a reference plane or a reference element substantially independent of the irregular vertical motions of the paver frame itself. Thus, it is possible to cause the floating screed to lay a pavement mat which is smooth and level.

Effective control of the screed may be achieved by means of a suitable position sensing device, for example, which is carried by one or both of the tow arms or other forward projections of the screed and arranged for contact with a predetermined reference surface. When the position sensing device becomes either higher or lower than is indicated by the reference surface, as with changing loads upon paver frame and/or irregularities in the roadbed surface, the tow point is caused to be controllably raised or lowered relative to the paver frame to maintain a constant relationship between the position sensing device, called the grade sensor, and the reference. In many applications, grade control is provided at only one side of the machine. For controlling the other side, a slope control can be provided, which functions to maintain a constant relationship between screed ends at opposite sides, either on a level basis or with a predetermined transverse slope.

In conjunction with this type of tow point control, it is important to provide an appropriate reference for the position sensing device. One type of reference is a stringline or wire suspended beside the surface to be paved. The sensor on the paver tow arm engages and follows the stringline to maintain the tow arm at a desired distance from the reference, thereby controlling levelling of the mat by the screed. U.S. Pat. No. 3,604,512 to Carter shows an example of a grader using a stringline or wire reference. The stringline is time-consuming to install and obstructs access to the roadway.

The base surface and fresh mat can be used as a reference with a mobile reference beam that is carried along with the paver as it moves over the roadway base surface. An arrangement of this type is described and claimed in U.S. Pat. No. 3,259,034 to Davin, incorporated herein by reference. In the arrangement of the Davin patent, an elongated beam structure is provided with a plurality of independent supports. The individual supports follow minor deviations in base contour without significantly affecting the position of the reference beam as a whole, and the mobile reference beam thus provides a suitably accurate, averaged reference plane representing the grade to which the pavement mat is to be applied. A sensing device carried by forward projections of the screed engages the reference beam near its center, to enable the screed to be maintained in a predetermined relationship to the moving reference beam. U.S. Pat. No. 3,846,035 to Davin, incorporated herein by reference, discloses a moving reference beam arrangement in connection with the laying of wide pavement mats, utilizing a combination of reference beams, one being towed ahead of the screed and auger, supported on the roadway base grade, and the other being towed behind the screed and auger, supported on the just-laid asphalt mat.

Another type of system that uses the base surface as a reference is available from Paveset America, Inc. A survey of the paving site is prepared prior to paving and survey data is input to a computer. A beam with shoes or skis senses the base surface and a wheel measures forward travel. The computer controls the screed based on the survey data and forward travel distance.

In some cases, a laser is used as a reference. A laser emitter is set at a certain position near the paving site. A laser sensor determines the elevation of the screed or other levelling device with respect to the laser. The laser emitter is set up after a survey of the site and must be moved periodically as the paver progresses along the roadway. Laser references are shown in U.S. Pat. No. 5,288,166 to Allen, U.S. Pat. No. 5,288,167 to Gaffard, U.S. Pat. No. 5,328,295 to Allen. U.S. Pat. No. 5,333,966 to St-Louis uses a laser to sense distance from a reference during a road painting operation.

After a pavement is laid by a machine such as those described above, one of the most important measures of the quality of the newly paved road surface is smoothness, that is, the number and size of bumps and dips in the pavement. Smooth roads require less maintenance and help conserve fuel. They also provide for a more comfortable ride. Because of the importance of smooth roads, most contractors must adhere to strict specifications concerning the smoothness of the roads they construct. A road which does not meet the specifications may result in the forfeiture of part of the contract price or may require grinding or filling parts of the pavement, both of which are costly to the contractor. On the other hand, pavement which exceeds specifications for smoothness may result in bonus payments to the contractor. Thus, it is desirable to obtain smoothness data on a newly paved road to determine whether specifications are being met.

A number of devices have been used for measuring the smoothness or "profile" of a road. One profiler currently in use is the profilograph, which is an elongated beam or frame supported on several wheels. The beam establishes a datum from which deviations in the road surface can be measured. A sensing wheel rolls on the surface and moves vertically as it travel over bumps and dips in the road. Originally, profilographs were entirely mechanical devices which used a linkage to transmit the vertical movement of the sensing wheel to a pen which traced a plot of the road surface on a moving roll of paper. The profiler plots the elevation of the surface as a function of distance travelled. Typically, a calibrated wheel is used to measure the distance. The plot is analyzed by laying a template with a "blanking band" over the plot. The blanking band defines a tolerance and blanks out minor aberrations.

Profilographs have advanced to the point where data from the sensing wheel is transmitted electrically and can be printed or stored in a computer for later analysis. Some computers provide the capability to automatically analyze the plot by applying an electronic blanking band. It is desirable to obtain profile information soon after laying a fresh mat. Profilers mounted with paving apparatus are shown in U.S. Pat. No. 3,675,545 to Anderson and U.S. Pat. No. 5,362,177 to Bowhall, incorporated herein by reference.

The Global Positioning System (GPS) is a satellite navigation system that includes a plurality of satellites stationed in geosynchronous orbit. These satellites receive signals from fixed ground stations and transmit signals that can be used to determine the position of a receiver adapted to process the signals. GPS provides two positioning services: precise positioning service (PPS), which is reserved for military use and standard positioning service (SPS), which is available to the public. The satellites are synchronized to an atomic clock. A receiver synchronized with an atomic clock can measure the propagation time of signals, and therefore the distance, from three satellites. A user can then determine the position of the receiver in three dimensions. Where the receiver is not synchronized to an atomic clock, measuring an apparent propagation time from a fourth satellite permits correction of any error in the receiver's clock. If positioning in only two dimensions is required, signals from only three satellites are necessary. The receiver must also account for Doppler frequency shifting of the signal resulting from motion of the satellite and motion of the receiver. The signals can also be used to determine time of day and velocity of the receiver. Receivers that will provide position information based on GPS signals are commercially available.

SUMMARY OF THE INVENTION

The invention provides a road working apparatus for working a surface and a profiler for measuring smoothness of the surface. The profiler includes a reference member, and a support for locating the reference member above the surface. A measurer is provided for measuring a distance between a point on the reference member and the surface. A receiver is adapted for receiving a positioning signal from a transmitter from which the position of the reference member can be determined.

The transmitter is preferably a plurality of fixed transmitters of a satellite navigation system, such as Global Positioning Satellites. The position is determined as a distance travelled by the reference member. The receiver and positioning signal are adapted for determining the position in at least two dimensions, as terrestrial coordinates.

A position calculator is adapted for determining the position of the reference member from the positioning signal. A plotter is provided for determining a smoothness profile of the surface by plotting distance measured between the reference member and the surface as a function of reference member position. A plotter output transfers smoothness information to a processor and/or a measurer output for transfers measured distances to the processor.

The reference member comprises an elongated reference beam and the support is a plurality of ground engaging wheels independently supporting the beam.

The road working apparatus includes a movable vehicle and a leveller disposed on the vehicle for forming a mat of material on a base surface. A receiver is adapted for receiving a positioning signal from a transmitter from which the position of the leveller can be determined. A leveller controller for controlling the leveller responsive to base surface profile information provided thereto and position information from the receiver. The formed mat is substantially level. The position is determined as a distance travelled by the leveller. The leveller controller controls leveller height. The road working apparatus according also includes a profiler of the type described above. The measurer of the profiler is connected for inputting distances measured to the leveller controller. The profiler is pushed ahead of the vehicle and the surface is a base surface on which material is to be formed. Alternatively, the profiler is towed behind the vehicle and the surface is the mat of material.

An auger is adapted for distributing material ahead of the leveller. The leveller is a floating screed and the material is paving material. The receiver is mounted for movement with the leveller and the position information includes elevation of the leveller.

Another embodiment of the profiler includes a receiver adapted for receiving a positioning signal from a transmitter from which the position of the receiver can be determined. A ground engaging support is movable on the surface, said receiver being mounted to the support such that the receiver is maintained a substantially constant distance from the surface. A plotter records elevation of the surface as a function of distance travelled by the support based on the position of the receiver. The support comprises a wheel adapted for travel on the surface. The receiver is mounted to an axle of the wheel for rotation on the axle so as to maintain a substantially constant pitch. The road working apparatus includes such a profiler travelling ahead of and/or behind the leveller.

The invention also includes a method of working a surface including the steps of determining a smoothness profile for the surface using signals from a fixed transmitter transmitting positioning signals as a reference; moving a vehicle over the surface and controlling a leveller on the vehicle to form a mat of material on the surface; and determining a position of the leveller in at least two dimensions based on position signals from the transmitter, said leveller being controlled based on the smoothness profile and the position of the leveller.

Additional steps include storing the smoothness profile in a memory; determining a second smoothness profile of the mat after forming the mat; and controlling the leveller based on the second smoothness profile. The elevation of the leveller is determined from positioning signals transmitted by the transmitter.

Profile and smoothness data can be displayed or stored and, under specified conditions can activate alarms or indicators. Stored data can be retrieved to create a graphic profile of the mat, which can be used to analyze paver or crew performance and the effects of various conditions present during paving. The graph can lead one back to a particular point on the mat for correction or analysis. A keyboard is also provided for operator input and control.

During a paving operation, the invention can provide immediate feedback regarding the smoothness of the fresh asphalt mat. If the desired smoothness is not being achieved, the problem can be diagnosed and corrective action can be taken to ensure that the asphalt yet to be laid will be sufficiently smooth. If necessary, the asphalt already laid can be rolled or filled while it is still plastic.

To more fully automate the system, smoothness information can be connected to directly modify grade and/or slope control of the paver. In this way, human error and delayed response can be avoided.

DESCRIPTION OF THE PREFERRED EMBODIMENT

Similar devices in a view are referred to generically by a two digit number and separately with a letter suffix. Similar devices in different embodiments are referred to with two and three digit numbers, the last two digits being identical.

Figure 1:
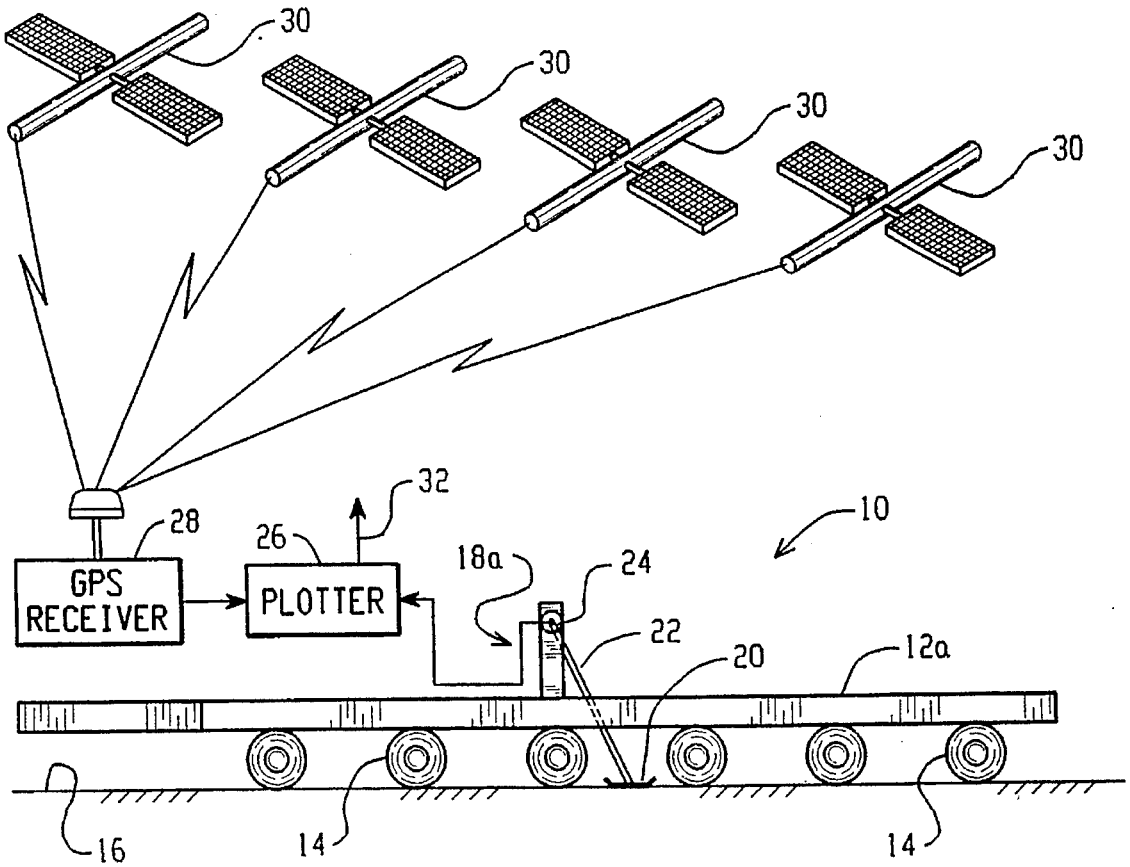
FIG. 1 shows a partially schematic side elevation of a profiler and position reference system according to the invention.

Referring to FIG. 1, a profiler 10 includes a reference member, such as an elongated beam 12*a*, supported on a plurality of ground engaging supports, such as wheels 14. The wheels 14 ride on a surface, such as a base surface 16 prepared for paving. The beam 12*a* is supported above the surface 16 by independent suspensions associated with each of the wheels so that the beam defines a reference spaced a constant distance from the average height of the base surface 16. The profiler 10 is provided with an elevation measurer 18*a* for measuring the distance from the surface 16 to a reference point on the beam 12*a*. The measurer 18*a* includes a ground engaging member, such as a shoe 20, adapted to ride on the surface 16. The shoe 20 is journalled on a pivotable arm 22 connected to operate a potentiometer 24 or other device suitable for providing a signal indicating the elevation of the shoe 20 relative to the beam 12*a*. The shoe 20 contacts the surface 16 about midway along the length of the beam 12*a*.

The profiler 10 is adapted to be towed or pushed manually or by a paver or other vehicle. The potentiometer 24 is connected to a processor, such as a plotter 26 adapted to plot the elevation of the shoe 20 as a function of the forward travel position of the beam 12*a*. The plotter 26 can be a type known for use with profilographs and can include a microprocessor, a memory for storing plots, a printer, desired output connections, and a keyboard or other input device. A GPS receiver 28 is mounted on the profiler 10 and adapted to receive positioning signals from GPS satellites 30. Such GPS receivers are commercially available from Motorola, for example. The satellites 30 are a plurality of transmitters in geosynchronous orbits around the earth, that is the transmitters are fixed relative to the surface of the earth. The receiver 28 or the plotter 26 includes a position calculator adapted to determine its position and, therefore, the position of the reference beam 12*a* based on GPS signals received from the satellites 30. The position is preferably determined in two dimensions with reference to terrestrial coordinates, such as latitude and longitude of geodetic or geocentric coordinate systems. The GPS receiver 28 is connected to provide position information to the plotter 26.

Figure 2:
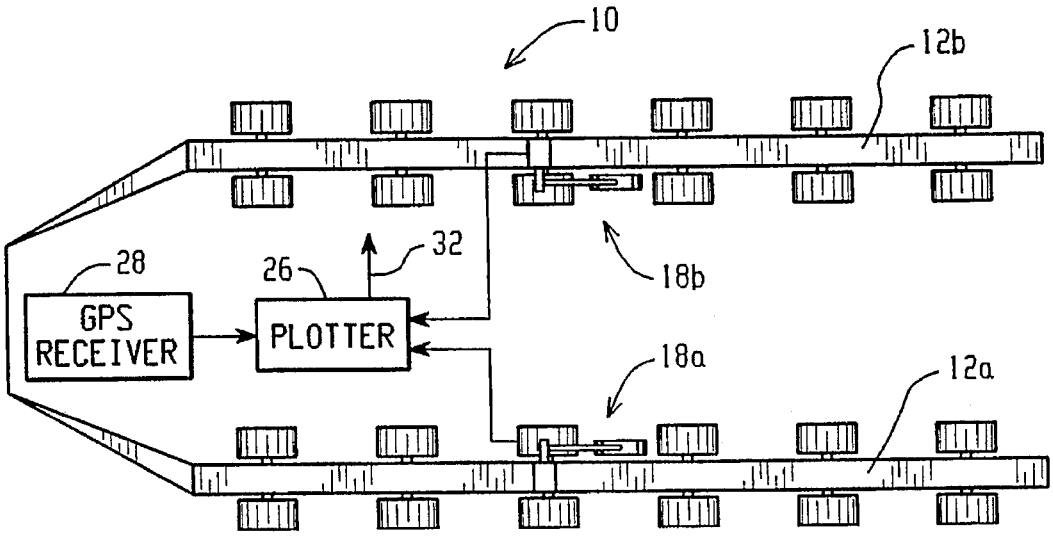
FIG. 2 shows a plan view of the profiler of FIG. 1.

Referring to FIG. 2, the profiler 10 includes a second beam 12*b*, a substantially identical mirror-image of the first beam 12*a*, equipped with like components, and disposed parallel therewith. The elevation measurer 18*b* of the second beam 12*b* is also connected to provide an elevation signal to the plotter 26. Using the two measurers 18 on the two beams 12, the plotter can provide two plots of the smoothness profile of the base surface 16. The smoothness profile is a plot of the distances measured from the reference beams 12 to the surface 16 as a function of beam 12 position, determined from the GPS signals received. The plotter 26 has an output 32 for transferring profile information, such as smoothness information, position information, and measured distance information.

Figure 3:
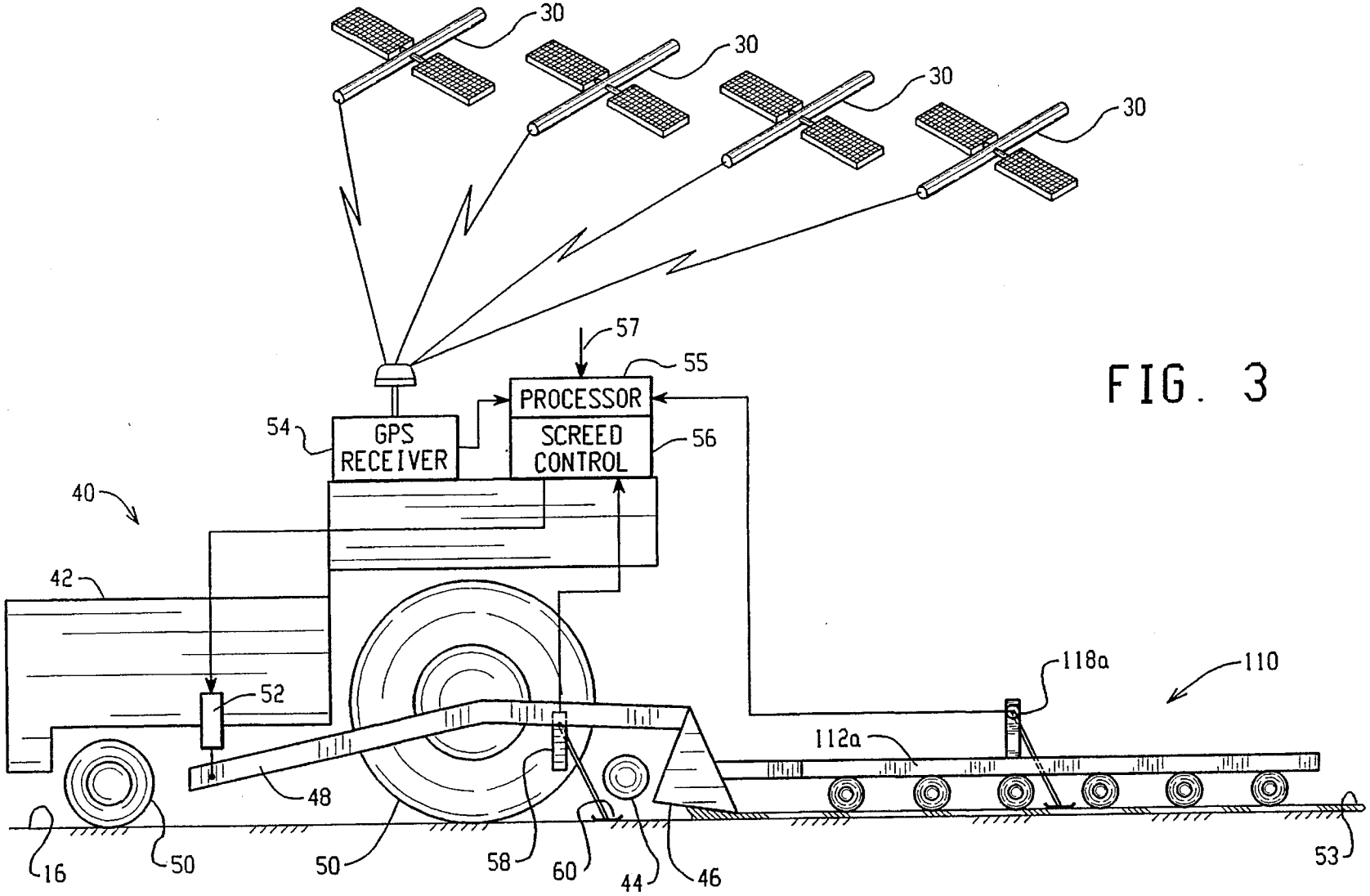
FIG. 3 shows a partially schematic side elevation of a paver towing a profiler and the position reference system according to the invention.
Figure 4:
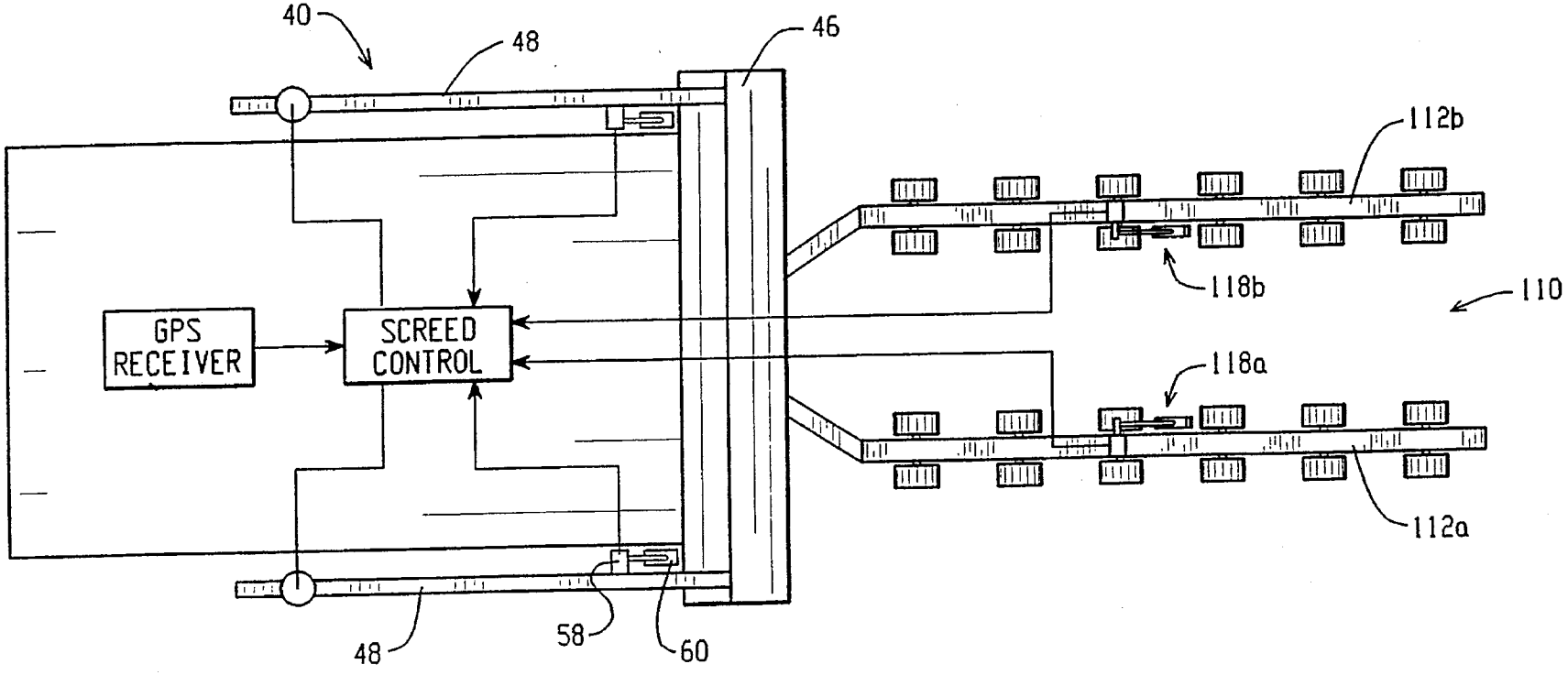
FIG. 4 shows a plan view of the paver and profiler of FIG. 3.

Referring to FIGS. 3 and 4, a road working apparatus, such as a paver 40, grader, or grinder, is a self-propelled or towed vehicle. The paver 40 includes a hopper 42 adapted for receiving paving material, such as asphalt, therein. The asphalt is moved by an internal slat conveyor (not shown) to a laterally extending auger 44. The auger 44 distributes paving material ahead of a material leveller. In the embodiment shown, the leveller is a floating screed 46 towed behind the paver by a pair of tow arms 48. Alternatively, the leveller can be a grading blade, a grinding tool, or other road working device. The paver rides on wheels 50 or tracks driven by a prime mover (not shown) adapted to move the paver 40 over the base surface 16. The screed 46 is adapted for levelling the paving material as the paver 40 travels forwardly. The tow arms 48 can be raised or lowered by an actuator 52, such as a hydraulic drive, to adjust the angle of attack of the screed 46, thereby changing the elevation of the screed and controlling the thickness or height of the fresh mat 53 of paving material.

The paver 40 is provided with a GPS receiver 54 similar to the GPS receiver described above. The GPS receiver 54 is connected to provide a signal indicating the position of the paver 40 and, therefore, the position of the screed to a processor 55 of a screed controller 56. The processor 55 is provided with an input 57 for receiving profile information from the plotter output 32 (FIG. 1). The screed controller is connected to operate the actuator 52 to control the elevation of the screed 46, as discussed below. The elevation of the screed is measured with a screed elevation measurer 58 mounted on the screed 46 or a rear part of the tow arm 48 near the screed. A shoe 60 of the elevation measurer 58 rides on the base surface 16 immediately ahead of the screed and paving material. The screed elevation measurer 58 is connected to provide a signal indicating the elevation of the screed to the screed control 56. The signal can be corrected to account for variations in the base surface based on input from the profiler 10 (FIG. 1).

The paver 40 is adapted for towing a profiler 110 similar to the profiler 10 described above. Each beam 112*a*, 112*b* of the profiler 110 towed by the paver 40 has a fresh mat elevation measurer 118*a*, 118*b* with a shoe 120*a*, 120*b*. Each fresh mat measurer 118 measures the distance from a reference (a point on the beam 112) to the surface of the fresh mat. The fresh mat measurers 118 are connected to provide elevation data representing the height of the fresh mat surface 53 to the screed control 56.

The elevation measurers 18, 58, 118 described are electromechanical devices that physically contact the surface to which the distance is being measured. Other devices would also be suitable, for example, ultrasonic or laser distance measurers. The reference members, beams 12 and 112, are physically supported on the surface being measured to provide an average height serving as the reference. Other devices would also be suitable, for example, the beams can be supported on shoes. Alternatively, a separate, fixed reference, such as elevation information obtained from the GPS system, can be used, as discussed below with reference to FIGS. 6 through 8.

Figure 5:
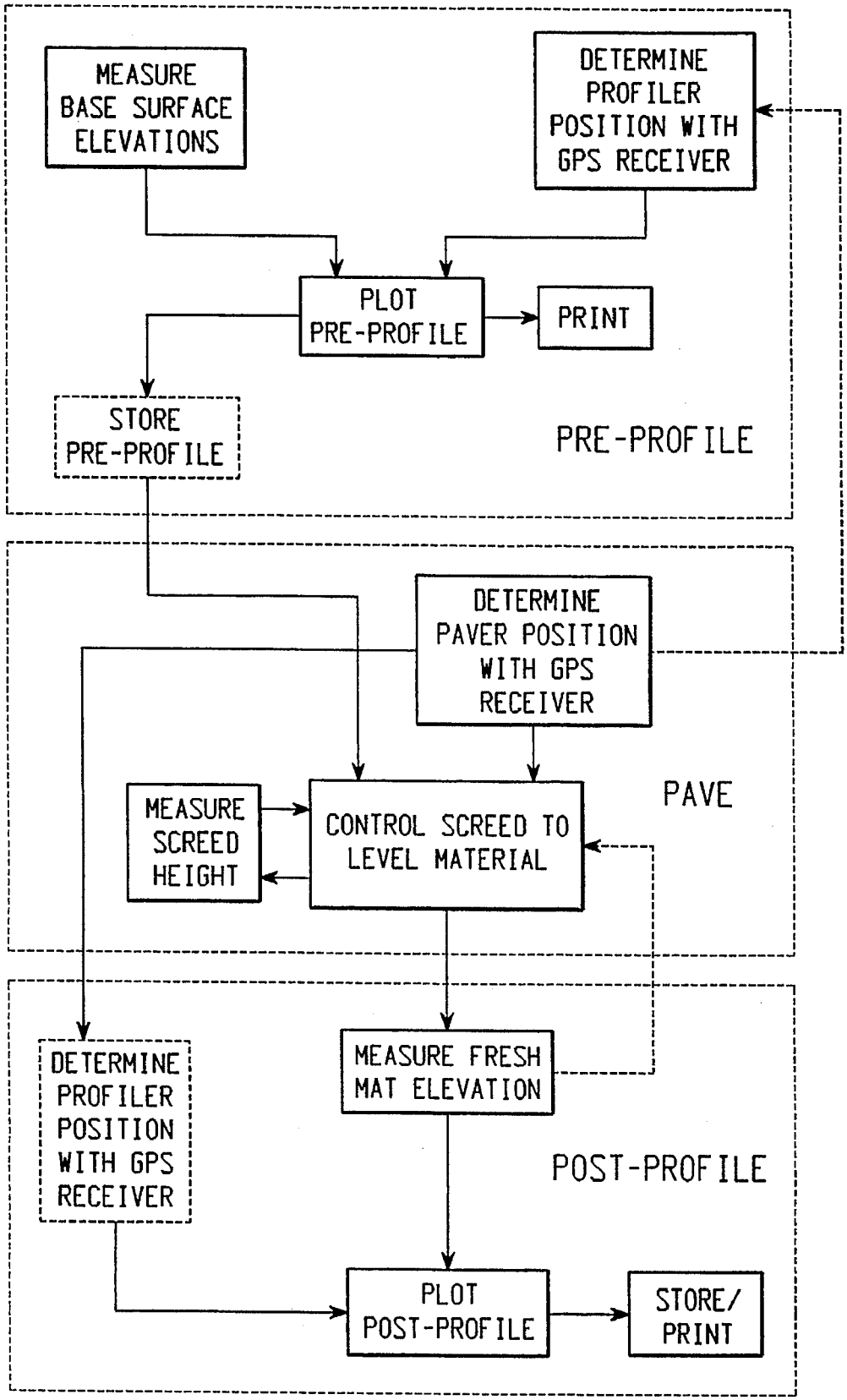
FIG. 5 shows a flow chart of a paving operation according to the invention.

Referring to FIG. 5, a paving operation begins with a "pre-profile" obtained by pushing or towing the profiler 10 over the base surface 16 to be paved. The GPS receiver 28 inputs position information and the elevation measurers 18 input elevation information to the plotter 26. When the profiler 10 is pushed by the paver 40, the GPS receiver 54 on the paver can be used to determine profiler position. Using the information, the plotter 26 plots two profiles of the base surface 16 each as a function of distance travelled. The plots can be stored electronically or input directly to the screed control 56 of the paver 40 following the profiler 10.

The paver 40 travels over the same base surface 16 distributing paving material thereon. Position information from the paver GPS receiver 54 is input to the screed control 56 and matched with profile information from the plotter 26. Where the profile indicates a dip or low area in the base surface 16, the tow arm 48 and screed 46 are adjusted to lay more paving material. Conversely, if the profile indicates a bump or raised area, the tow arm 48 and screed 46 are adjusted to lay less paving material. The tow arms 48 are controlled in unison or independently to provide slope control. The screed elevation measurer 58 provides feedback information to the screed control 56 indicating the vertical position of the screed. Base surface profile information from the profiler 10 is used to adjust signals from the screed height measurer 58 to derive accurate screed 46 elevation information. For example, a dip in the base surface ahead of the screed would cause the screed elevation measurer to indicate incorrectly a rise of the screed. The profile of the base surface identifies the dip and is used by the screed controller to counteract this effect. The screed is controlled such that the amount of paving material forms a fresh mat 53 that is level after rolling.

The towed profiler 110 is preferably towed immediately behind the paver 40 to determine a "post profile." The fresh mat measurers 118 provide elevation information for the fresh mat 53 of paving material to the screed control. Using position information from the paver GPS receiver 54 and elevation information from the measurers 118, the screed control develops smoothness profiles for the fresh mat as a function of distance travelled. These profiles can be electronically stored or printed. The elevation information can also be used to determine profile characteristics outside a desired range so that corrective action can be taken by the screed control 56 to adjust the screed 46. If the fresh mat profiler 110 is not towed by the paver 40, it is provided with its own GPS receiver from which position information is matched with position information from the other receivers 28, 54. When the preprofiler and fresh mat profiler are linked to the vehicle, a single GPS receiver can be used for the entire apparatus with appropriate corrections for the locations of the measurers and screed.

Figure 7:
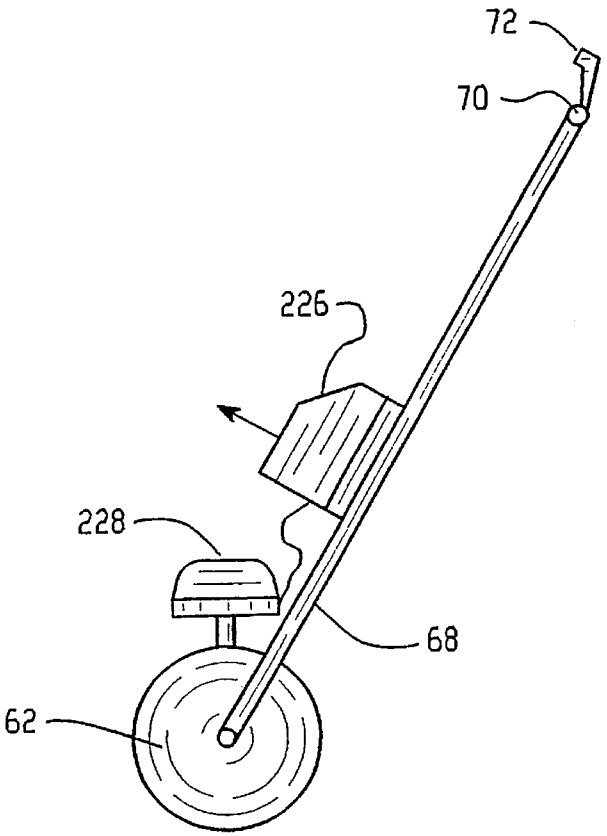
FIG. 7 shows a side elevation of the profiler of FIG. 6.
Figure 6:
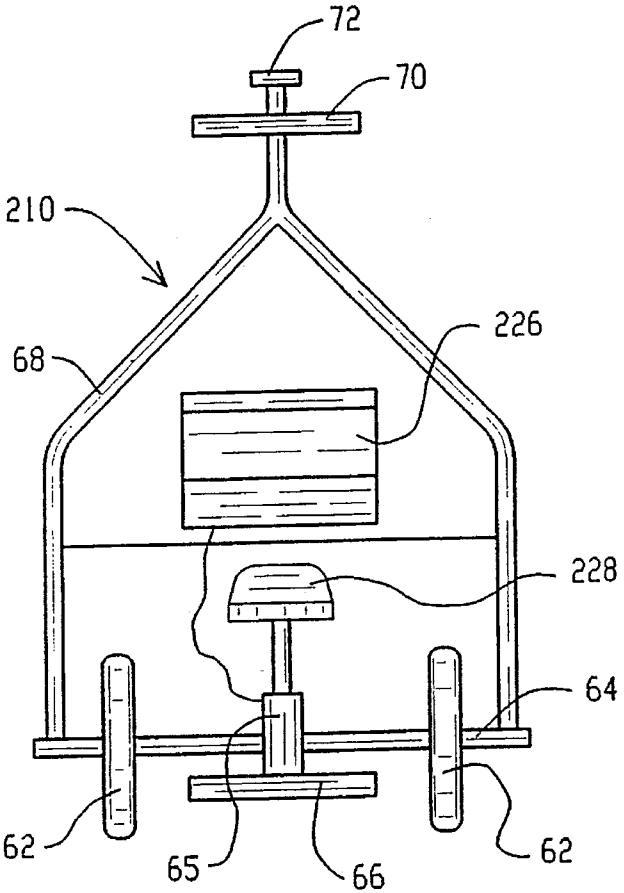
FIG. 6 shows a front elevation of a profiler according to another embodiment of the invention.
Figure 8:
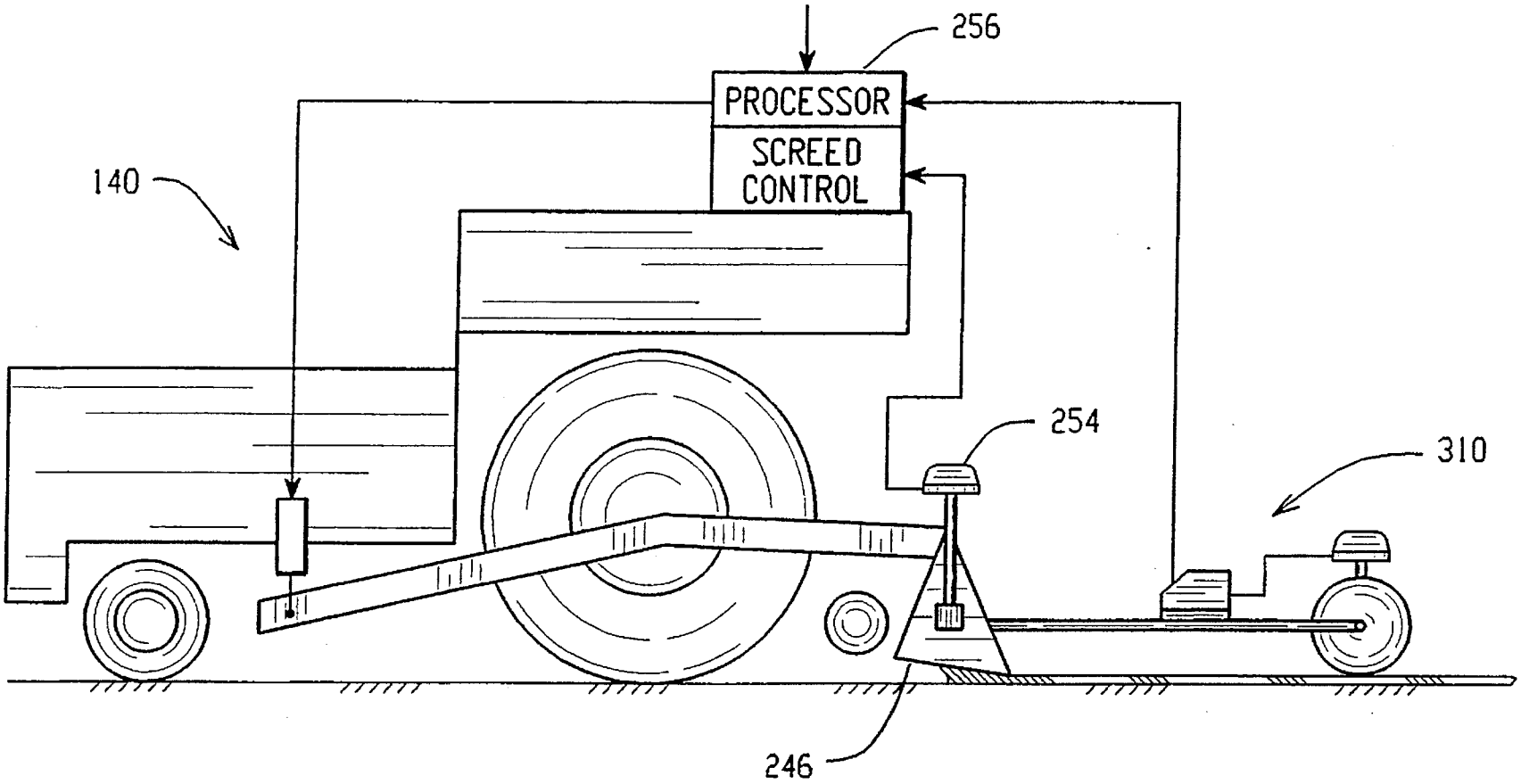
FIG. 8 shows a side elevation of another embodiment of a paver towing a profiler of the type shown in FIGS. 6 and 7.

Referring to FIGS. 6, 7, and 8, other embodiments of profilers 210 and 310 and a paver 140 use three dimensional position information from the fixed reference system. The profilers 210, 310 each include a pair of ground engaging supports, such as wheels 62 mounted on an axle 64. The diameter of the wheels 62 depends on the desired precision of smoothness measurement. Smaller wheels permit more precise measurements. A GPS receiver 228 is mounted on the axle 64 and connected to a plotter 226 or other processor or storage device. The receiver 228 is preferably journalled on the axle 64, preferably by a universal or gimbal joint 65, and maintained in an upright position by a counterbalance 66. A frame 68 with a handle 70 and a hitch 72 is journalled to the axle 64 for pushing or pulling the profiler 210. The plotter 226 is mounted on the frame 68.

The paver 140 is generally the same as the paver 40 of FIGS. 3 and 4. A GPS receiver 254 is mounted on the screed 246 for movement therewith. The receiver 254 is adapted for determining its own position, and therefore the screed's position, in three dimensions. The receiver 254 is connected to transfer position information to a screed controller 256. The screed controller 256 has inputs for receiving position information from the profilers 210, 310. The screed controller 256 is adapted for controlling the screed 246 based on profile information from the profilers 210, 310 and position information from the receiver 254 on the screed. Such a construction is suitable to the extent permitted by the accuracy of the GPS signals available to the public.

The method of profiling is substantially as described above with reference to FIG. 5. The preprofile is measured with the profiler 210, which is moved manually, towed by a vehicle, or pushed by the paver 140. The wheels 62 follow the contours of the surface, causing the receiver 228 to rise and fall with bumps and dips in the surface. The elevation is recorded by the plotter 226 as a function of forward travel distance determined from the position of the receiver 228. The universal joint 65 and counterbalance 66 maintain the receiver at a constant attitude (particularly, a constant pitch) and constant distance from the surface to minimize errors from tilting of the profiler. The receiver can be mounted at the axle to minimize deflection, but must have a clear receiving path from three or four satellites. With a wide wheel base and sufficiently accurate receiver, the gimbal joint can be eliminated and lateral deflections can be used to measure slope variations.

The preprofile is transferred to the screed control 256 directly or from a storage device, either as a plot of smoothness or as separate elevation and terrestrial position information, such as distance travelled from a reference point. The paver lays paving material on the base surface and the screed 246 is operated to level the paving material. The elevation of the screed 246 is controlled based on the preprofile information and the position, including elevation, of the screed. The position of the screed is determined from the receiver 254 mounted on the screed. Profile information from the profiler 310 towed by the paver 140 can also be used to control the screed. Where the profile of the base surface is measured prior to the paving operation, the same profiler can then be hitched to the paver 140, thereby eliminating the need for two profilers. Two profilers can also be used side by side for slope measurements and slope control.

What is claimed is:

1. A road working apparatus for use with a transmitter fixed relative to the surface of the earth, said road working apparatus comprising:

a movable vehicle;

a leveller disposed on the vehicle, said leveller forming a mat of material on a base surface and said mat of material having an upper surface;

a first receiver on said vehicle receiving a positioning signal from said transmitter and generating position information expressing the position of the leveller with respect to the earth;

a leveller controller for controlling the leveller; and means for providing base surface profile information to said leveller controller, wherein said leveller controller controls said leveller based upon said base profile information and said position information.

2. A road working apparatus according to claim 1 wherein the formed mat is substantially level.

3. A road working apparatus according to claim 1 wherein the position is determined as a distance travelled by the leveller.

4. A road working apparatus according to claim 1 wherein the first receiver and positioning signal are adapted for determining the position in at least two dimensions.

5. A road working apparatus according to claim 1 wherein the first receiver and positioning signal are adapted for determining the position as terrestrial coordinates.

6. A road working apparatus according to claim 1 wherein the leveller controller controls leveller height.

7. A road working apparatus according to claim 1 further comprising a profiler adapted for travel with the vehicle, said profiler comprising:

a reference member movable with the vehicle;

a support for locating the reference member above one of said base surface and said upper surface; and a measurer for measuring a distance from a point on the reference member to said one of said base surface and said upper surface.

8. A road working apparatus according to claim 7 further comprising a plotter for determining a smoothness profile of said one of said base surface and said upper surface by plotting a distance measured between the reference member and said one of said base surface and said upper surface as a function of reference member position.

9. A road working apparatus according to claim 7 wherein the measurer is connected for inputting distances measured to the leveller controller.

10. A road working apparatus according to claim 7 wherein the leveller controller is adapted for determining the position of the measurer based on position information from the first receiver.

11. A road working apparatus according to claim 7 wherein the profiler is pushed ahead of the vehicle and said one of said base surface and said upper surface is said base surface.

12. A road working apparatus according to claim 7 wherein the profiler is towed behind the vehicle and said one of said base surface and said upper surface is said upper surface.

13. A road working apparatus according to claim 12 wherein the reference member comprises an elongated reference beam and the support comprises a ground engaging member for supporting the reference beam above said upper surface.

14. A road working apparatus according to claim 13 wherein the support comprises a plurality of wheels independently supporting the beam.

15. A road working apparatus according to claim 1 further comprising an auger adapted for distributing material ahead of the leveller.

16. A road working apparatus according to claim 1 wherein the leveller is a floating screed.

17. A road working apparatus according to claim 1 wherein the material is paving material.

18. A road working apparatus according to claim 1 wherein the first receiver is mounted for movement with the leveller and the position information includes elevation of the leveller.

19. A road working apparatus according to claim 18 further comprising an auger adapted for distributing material ahead of the leveller.

20. A road working apparatus according to claim 18 wherein the leveller is a floating screed.

21. A road working apparatus according to claims 18 wherein the material is paving material.

22. A road working apparatus according to claim 18 further comprising a profiler adapted for travelling ahead of the leveller, said profiler comprising a second receiver adapted for receiving a positioning signal from a fixed transmitter from which the position of the second receiver can be determined; and a ground engaging support for locating the second receiver relative to said base surface.

23. A road working apparatus according to claim 22 wherein said first and second receivers are adapted for determining the positions in at least two dimensions.

24. A road working apparatus according to claim 22 wherein the position of the second receiver includes elevation of said base surface.

25. A road working apparatus according to claim 22 further comprising an auger adapted for distributing material ahead of the leveller.

26. A road working apparatus according to claim 22 wherein the leveller is a floating screed.

27. A road working apparatus according to claim 22 wherein the material is paving material.

28. A road working apparatus according to claim 22 further comprising a second profiler for travelling behind the leveller, said second profiler comprising a third receiver adapted for receiving a positioning signal from a fixed transmitter from which the position of the third receiver can be determined; and a second ground engaging support for locating the third receiver relative to said upper surface.

29. A road working apparatus according to claim 28 wherein said first, second, and third receivers are adapted for determining the positions in at least two dimensions.

30. A road working apparatus according to claim 28 wherein the position of the third receiver includes elevation of said upper surface.

31. A road working apparatus according to claim 18 further comprising a profiler adapted for travelling ahead of the leveller, said profiler comprising a second receiver adapted for receiving a positioning signal from a permanent transmitter from which the position of the second receiver can be determined; and a ground engaging support for locating the second receiver relative to said base surface.

32. A road working apparatus according to claim 31 wherein said first and second receivers are adapted for determining the positions in at least two dimensions.

33. A road working apparatus according to claim 31 wherein the position of the second receiver includes elevation of said base surface.

* * * * *